US006581514B2

(12) United States Patent
Kakurai

(10) Patent No.: US 6,581,514 B2
(45) Date of Patent: Jun. 24, 2003

(54) PRINT MEDIUM FEED DEVICE AND STENCIL PRINTING MACHINE

(75) Inventor: Osamu Kakurai, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/859,414

(22) Filed: May 18, 2001

(65) Prior Publication Data

US 2001/0047732 A1 Dec. 6, 2001

(30) Foreign Application Priority Data

Jun. 1, 2000 (JP) ..... 2000-164618

(51) Int. Cl.[7] ..... B41L 13/00
(52) U.S. Cl. ..... 101/118; 101/232
(58) Field of Search ..... 101/115, 116, 101/118, 183, 231, 232; 400/641, 642; 271/184, 185

(56) References Cited

U.S. PATENT DOCUMENTS 4,202,478 A * 5/1980 Kula ..... 226/189
5,438,347 A * 8/1995 Shishido et al. ..... 347/218
5,713,279 A * 2/1998 Iida et al. ..... 101/128.4
5,931,090 A * 8/1999 Ohkawa ..... 101/118

* cited by examiner

*Primary Examiner*—Ren Yan
(74) *Attorney, Agent, or Firm*—Gary M. Nath; Harold L. Novick; Marvin C. Berkowitz

(57) ABSTRACT

A print medium feed device and a stencil printing machine employing the same are disclosed wherein a print medium as a print sheet, transferred with a pair of secondary paper feed rollers, is transferred through a pair of transfer guide members to a press drum by which transfer of the print medium is succeeded. An upper transfer guide member, with which the print medium is brought into sliding contact, is periodically shifted between a guide position to allow the print medium to be guided to the press drum, and an inoperative non-guide position in which the upper transfer guide member is separated from the other transfer guide member. A shaft of one secondary paper feed roller is exerted with a rotational braking effect by a torque limiter, whose rotational braking effect is periodically released by a clutch unit.

18 Claims, 8 Drawing Sheets

PRINT MEDIUM FEED DEVICE AND STENCIL PRINTING MACHINE

BACKGROUND OF THE INVENTION

The present invention relates to a print medium feed device for feeding a print medium to a press drum or the like and a stencil printing machine using such a print medium feed device and, more particularly, to a print medium feed device and a stencil printing machine adapted to transfer a print medium such as a print sheet in a feed path wherein an initial transfer angle of the print medium relative to a feed tray is remarkably different from a subsequent advancing angle of the print medium relative to the press drum.

Various researches and developments have been undertaken to provide an improved paper feed device for a stencil printing machine allowing to perform multi-colored print with plural printing drums, a typical example of which is disclosed in FIG. 8 which shows a part of a structure of such a stencil printing machine. In FIG. 8, first and second printing drums 101 and 102 and a press drum 103 are rotatably supported in a frame body (not shown) such that the first and second printing drums 101 and 102 are located in close proximity to an outer periphery of the press drum 103 at positions angled at 90 degrees of a central angle of the press drum 103. Outer circumferential peripheries of the respective first and second printing drums 101 and 102 carry thereon stencil clamping bases 101*a* and 102*a*, respectively, which support thereon sheet clamping segments 101*b* and 102*b* for clamping stencil sheets (not shown) onto the stencil clamping bases 101*a* and 102*a,* respectively.

Further, screens 105 are wound on the outer circumferential peripheries of the first and second printing drums 101 and 102 in a stretched state with the use of the stencil clamping bases 101*a* and 102*a* and springs 104, with each of the screens 105 being formed of a mesh-shaped porous structure which allows printing ink to permeate. Inner press rollers 106 and 107, which serve as ink supply rollers, respectively, are located inside the screens 105 of the first and second printing drums 101 and 102, respectively, with the inner press rollers 106 and 107 being moveable between a wait position not to press the screens 105 and a press-contact position to press the screens 105. During printing operation, the inner press rollers 106 and 107 are maintained in the press-contact position, in which the screens 105 are expanded outward. Also, it is arranged such that the screen 105 of the first printing drum 101 is supplied with printing ink in a first color by the inner press roller 106 and the screen 105 of the second printing drum 102 is supplied with printing ink in a second color by the inner press roller 107. The outer circumferential periphery of the press drum 103 is provided with a print sheet clamping segment 109, for clamping a leading edge of a print sheet (print paper) 108, which clamps the leading edge of the print sheet 108 transferred from a paper feed device 110 and release the leading edge of the print sheet 108 at a position in the vicinity of an inlet portion of a sheet discharge section 111.

The paper feed device 110 is constructed of a paper feed tray 112 on which a stack of print sheets 108 are located, a pair of primary paper feed rollers 113, 113 which are held in press-contact with an uppermost print sheet 108 stacked on the paper feed tray 112, a pair of secondary paper feed rollers 114, 114 located downstream of the primary paper feed rollers 113, 113, and a pair of transfer guide members 115, 115 which function to guide the print sheet 108 in a transfer path between the pair of secondary paper feed rollers 114, 114 and the press drum 103. Rotations of the primary paper feed rollers 113, 113 allow only the uppermost print sheet 108 to be transferred from the paper feed tray 112 to the pair of secondary paper feed rollers 114, 114. The print sheet 108 is then transferred with rotations of the pair of secondary paper feed rollers 114, 114 and is fed to the press drum 103 in synchronism with rotation thereof.

Now, the stencil printing machine thus arranged operates as follows. A leading edge of a first stencil sheet, which has been made on the basis of image data in a first color of an original is clamped with the sheet clamping segment 101*b* of the first printing drum 101, and a leading edge of a second stencil sheet, which has been made on the basis of image data in a second color of the original, is clamped with the sheet clamping segment 102*b* of the second printing drum 102, with the stencil sheets being mounted onto the outer circumferential peripheries of the respective screens 105. Next, the first and second printing drums 101 and 102 and the press drum 103 are rotated in synchronism with one another in directions as shown by arrows in FIG. 8, thereby causing the print sheet 108 to be transferred between the first printing drum 101 and the press drum 103 from the paper feed device 110.

The print sheet 108 thus transferred is clamped with the print sheet clamping segment 109 of the press drum 103, allowing the print sheet to pass along the outer circumferential periphery of the press drum 103 between the first printing drum 101 and the press drum 103. During this passing step of the print sheet 108, the inner press roller 106 is brought into press-contact with the screen 105 of the first printing drum 101 which is consequently expanded outward, allowing printing ink to be transferred to the print sheet 108 to reproduce a desired image pattern with a first color through a perforated image area of the first stencil sheet. The print sheet 108, which has passed between the first printing drum 101 and the press drum 103, then passes between the second printing drum 102 and the press drum 103. During this passing step of the print sheet a 108, the inner press roller 107 is brought into press-contact with the screen 105 on the second printing drum 102 which is consequently expanded outward, allowing printing ink to be transferred to the print sheet 108 to reproduce a desired image pattern with a second color. As the sheet clamping segment 109 of the press drum 103 is rotated to a position near the inlet of the sheet discharge section 111, the sheet clamping segment 109 is released, with the released print sheet 108 being discharged to the given discharge position by the sheet discharge section 111. In this manner, two-color printing is completed.

Now, operation of the paper feed device 110 is described in detail. When the primary paper feed rollers 113, 113 are rotated, only the uppermost print sheet 108 is transferred from the stack of the print sheets on the paper feed tray 112 until the leading edge of the print sheet 108 is introduced to a position between the secondary paper feed rollers 114, 114, at which position a further transfer of the print sheet 108 is stopped. Subsequently, the secondary paper feed rollers 114, 114 are rotated in synchronism with rotation of the press drum 103, allowing the print sheet 108 to be fed to the press drum 103, while guided with a pair of transfer guide members 115, 115, at a prescribed advancing point and at a prescribed advancing angle. The print sheet 108, thus transferred to the press drum 108, is successively transferred therewith.

In the event the pair of secondary paper feed rollers 114, 114 complete their transfer cycle, rotations of the secondary paper feed rollers 114, 114 are interrupted and one of the paper feed rollers 114, 114 is shifted to a disengagement position relative to the other paper feed roller. With such a shifting movement, the print sheet 108 is transferred without encountering with difficulties.

SUMMARY OF THE INVENTION

However, due to the further studies done by the inventor of the present invention, in a printing machine such as the machine discussed above, wherein two printing drums 101, 102 are located relative to a single press drum 103, however, since the first printing drum 101 is obliquely located above an upper region of the press drum 103 and a paper feed point is located at an upstream side of the first printing drum 101 in terms of rotation of the press drum 103, an advancing transfer direction of the print sheet 108 to the press drum 103 becomes substantially in a vertical direction. On the contrary, the print sheet 108 is transferred from the paper feed tray 112 in a transfer direction which is slightly angled at approximately 20 degrees relative to a horizontal direction. It will thus be understood from the foregoing description that a paper transfer path is formed with an initial transfer angle of the print sheet 108 to be transferred from the paper feed tray 112 and a subsequent advancing transfer angle of the print sheet 108 to be fed to the press drum 103, with both angles forming a remarkably large value angled from one another. In such a paper transfer path, during transfer of the print sheet 108 with the press drum 103, since the print sheet 108 tends to extend in a straight configuration due to its resilience such that a trailing edge of the print sheet 108 is transferred through the pair of the transfer guide members 115, 115 with the trailing edge remaining in sliding contact with one of the transfer guide members, a situation is encountered such that the print sheet 108 is subjected to a relatively large back tension caused by a sliding resistance. When the print sheet 108 is transferred while subjected to the back tension, difficulties are encountered in transferring the print sheet 108 in a stable fashion, resulting in a remarkable amount of undesired paper dusts. Particularly, these difficulties become more serious in a case where the print sheet 108 has an increased resilience property.

Further, in such a printing machine wherein a rotational braking unit is employed to exert a rotational braking effect onto a shaft of an upper one of the secondary paper feed rollers 114, 114 to prevent backlash of the same, since the print sheet 108 is transferred with its trailing edge remaining in sliding contact with the upper paper feed roller 114 which is exerted with the rotational braking effect, the print sheet 108 is undesirably subjected to the relatively large back tension with resultant similar problems discussed above.

The present invention has been achieved through the above-stated studies. It is, therefore, an object of the present invention to provide a print medium feed device which can minimize a back tension, to be exerted onto a print medium during transfer thereof with a press drum, as small as possible and a stencil printing machine which employs the same.

To obtain the above-stated object, in a first aspect of the present invention, a print medium feed device is provided with: a feed tray stacking print media thereon; a primary feed roller; a pair of secondary feed rollers provided downstream to the primary feed roller in a transferring direction of the print medium, the print medium being fed to the pair of secondary feed rollers through the primary feed roller in a first transferring direction; a pair of transfer guide members provided downstream to the pair of secondary feed rollers in the transferring direction of the print medium, the print medium being fed from the pair of secondary feed rollers to a predetermined member through the transfer guide members in a second transferring direction different from the first transferring direction; and an actuating mechanism shifting one of the pair of transfer guide members between a guide position in which the one of the pair of transfer guide members and the other of the pair of transfer guide members are close to each other to allow the print medium to be guided by the pair of transfer guide members and a non-guide position in which the one of the pair of transfer guide members is remotely separated from the other of the pair of transfer guide members.

In a second aspect of the present invention, a print medium feed device is provided with: a feed tray stacking print media thereon; a primary feed roller; a pair of secondary feed rollers provided downstream to the primary feed roller in a transferring direction of the print medium, the print medium being fed to the pair of secondary feed rollers through the primary feed roller in a first transferring direction; a pair of transfer guide members provided downstream to the pair of secondary feed rollers in the transferring direction of the print medium, the print medium being fed from the pair of secondary feed rollers to a predetermined member through the transfer guide members in a second transferring direction different from the first transferring direction; a rotational braking mechanism coupled to the pair of secondary feed rollers and imparting a rotational braking effect thereto; and a releasing mechanism releasing the rotational braking effect.

Besides, a stencil printing machine of the present invention is provided with: a rotatable press drum; a plurality of printing drums rotatably supported in close proximity to the press drum; a stencil making section making stencil sheets to be mounted onto outer circumferential peripheries of the respective printing drums; a feed tray stacking print media thereon; a primary feed roller; a pair of secondary feed rollers provided downstream to the primary feed roller in a transferring direction of the print medium, the print medium being fed to the pair of secondary feed rollers through the primary feed roller in a first transferring direction; a pair of transfer guide members provided downstream to the pair of secondary feed rollers in the transferring direction of the print medium, the print medium being fed from the pair of secondary feed rollers to a predetermined member through the transfer guide members in a second transferring direction different from the first transferring direction; and an actuating mechanism shifting one of the pair of transfer guide members between a guide position in which the one of the pair of transfer guide members and the other of the pair of transfer guide members are close to each other to allow the print medium to be guided by the pair of transfer guide members and a non-guide position in which the one of the pair of transfer guide members is remotely separated from the other of the pair of transfer guide members. In such a structure, a desired image pattern is formed on the print medium by supplying ink to the respective printing drums such that the ink is transferred to the print medium through the stencil sheets of the respective printing drums.

Other and further features, advantages, and benefits of the present invention will become more apparent from the following description taken in conjunction with the following drawings.

DETAILED DESCRIPTION OF THE PREFERRED EMBODIMENT

An preferred embodiment of a print medium feed device and a stencil printing machine according to the present invention will be described hereinafter in detail with reference to FIGS. 1 to 7B. In this embodiment, description will be given while taking a case of typically using a print sheet (print sheet) as a print medium.

Figure 1:
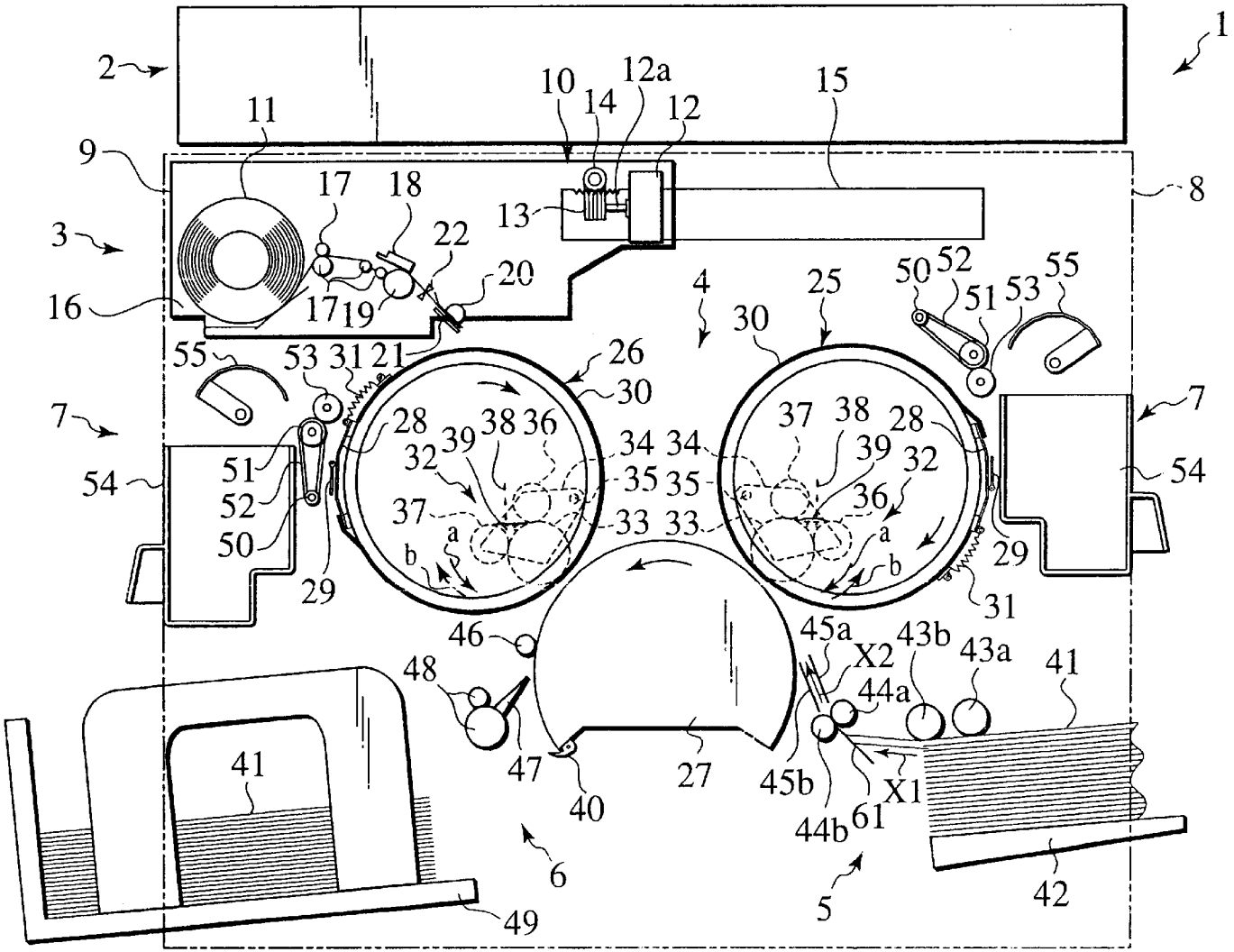
FIG. 1 is a schematic structural view of a stencil printing machine having a print medium feed device according to a preferred embodiment of the present invention.

Referring to FIG. 1, there is shown a preferred embodiment of a stencil printing machine employing a paper feed device as a print medium feed device according to the present invention. As shown in FIG. 1, the stencil printing machine 1 is mainly constructed of an original reader section 2, a stencil making section 3, a printing section 4, a paper feed device 5, a sheet discharge section 6, and stencil disposal sections 7 mounted at two locations, .

The original reader section 2 is located above a main body 8 and optically reads an image pattern, with an optically read data being converted to first and second electric signals which represent respective image data assigned for printing ink with printing colors to be reproduced by the first and second printing drums. Also, in this event, the image data can be further processed on the basis of given commands (i.e., commands for scale up or scale down, etc.).

The stencil making section 3 includes a stencil making unit 9 located in an upper portion of the main body 8 for horizontal movement. The stencil making unit 9 is moveable with a stencil making unit transfer device 10 between a first stencil sheet feeder position to allow a first perforated stencil sheet 11 to a first printing drum 25 and a second stencil sheet feeder position (i.e., a position shown in FIG. 1) to allow a second perforated stencil sheet 11 to a second printing drum 26. The stencil making unit transfer device 10 is constructed to have a stencil making unit transfer motor 12 fixed to the stencil making unit 9, a worm gear 13 fixed to a rotary shaft 12*a* of the stencil sheet making unit transfer motor 12, a worm wheel (not shown) meshing with the worm gear 13, a pinion gear 14 connected to the worm wheel in a concentric relationship therewith, and a rack 15 meshing with the pinion gear 14 and fixedly mounted to the machine frame 8.

The stencil making unit 9 includes a stencil sheet roll container 16 which receives an elongated stencil sheet 11 formed in a rolled shape, a plurality of feed rollers 17 adapted to guide a leading edge of the stencil sheet 11 received in the stencil sheet roll container 16 toward a downstream side, a thermal printing head 18 located at a downstream side of the feed rollers 17, a platen roller 19 which is located in an opposed position of the thermal printing head 18 and which rotates with drive force exerted by a pulse motor (not shown), a stencil sheet feed roller 20 located at a downstream side relative to the platen roller 19 and the thermal printing head 18 and adapted to be driven with the drive force of the pulse motor, a guide plate 21 to which the stencil sheet feed roller 20 is held in contact in a pressurized relationship, and a stencil sheet cutter 22 located between a pair of the stencil sheet feed roller 20 and the guide plate 21, and a pair of the platen roller 19 and the thermal printing head 18.

The printing section 4 includes a first printing drum 25, a second printing drum 26, and a press drum 27, which serves as a rotary printing press member to impart printing pressure, with both the first and second printing drums 25 and 26 being located above the press drum 27 in right and left directions at obliquely oriented positions. In particular, the first and second printing drums 25 and 26 are placed in close proximity to an outer circumferential periphery of the press drum 27 at positions angled 90 degrees relative to a central axis of the press drum 27. The first and second printing drums 25 and 26 and the press drum 27 are rotatably supported in the main body 8, and are rotated with a printing drum rotating mechanism (not shown) at the same circumferential speeds, as shown by arrows in FIG. 1, in the vicinities of a first contact zone between the first printing drum 25 and the press drum 27 and a second contact zone between the second printing drum 26 and the press drum 27. The printing drum rotating mechanism is driven with a main motor (not shown) that serves as a drive source.

The first and second printing drums 25 and 26 have respective annular frame pairs (bearing no reference numerals) which are interconnected with stencil clamping bases 28, forming respective parts of outer circumferential peripheries of the first and second printing drums 25 and 26, respectively. The stencil clamping bases 28 have respective stencil clamping segments 29, by which leading edges of the stencil sheets 11 are clamped. Also, leading edges of screens 30, which form respective outer circumferential peripheries of the first and second printing drums 25 and 26 and which serve as ink permeable members, are fixed to the stencil clamping bases 28, with each screen 30 being wound on each of outer circumferential peripheries of the first and second printing drums 25 and 26. An end portion of each screen 30 is stretched over each of the stencil clamping bases 28 by a spring 31, with each screen 30 being arranged to be expandable outward against the force of the spring 31. Each screen 30 is constructed of, for example, a mesh-shaped porous structure which, when it is pressed with an inner press roller 33, which serves as an ink supply roller as will be discussed below, permits printing ink 38 to permeate from inward to outward. Thus, the circumferential peripheries of the first and second printing drums 25 and 26 are formed with the ink permeable screens 30.

Inside each of the screens 30 of the first and printing drums 25 and 26, an inner press mechanism 32 is located.

Each inner press mechanism 32 includes the inner press roller 33 which has a first function in that the screen 30 is pressed from inside for printing, and a second function in that the printing ink 38 is supplied to the screen 30. Each of the inner press rollers 33 is rotatably supported by a pair of roller support members 34 located at both sides of each press roller and is rotated with a drive means, which is not shown, in synchronism with rotations of the first and second printing drums 25 and 26. The roller support members 34 are supported on a pivot shaft 35 for rotational movement thereabout such that, with rotation of the roller support members 34 in a direction as shown by an arrow a in FIG. 1, the roller support members 34 are moveable between an operative, press-contact position to cause the inner press roller 33 to press an inner periphery of the screen 30, and an inoperative, wait position when the roller support members 34 are rotated in a direction as shown by an arrow b. Each of the inner press rollers 33 assumes the press-contact position during printing operation and the wait position except during printing operation.

Further, the roller support members 34 carry first and second doctor rollers 36 and 37. The first and second doctor rollers 36 and 37 include cylindrical columns, respectively, and both are located in the vicinity of the inner press roller 33. The printing ink 38 is supplied to an outer periphery space of the inner press roller 33, i.e., in an upper space surrounded between the first and second doctor rollers 36 and 37 by an ink supply section (not shown), in which an ink pool 39 is constructed. The first printing drum 25 is supplied with printing ink 38 with a first color, and the second printing drum 26 is supplied with printing ink 38 with a second color. A gap between the first doctor roller 36 and the inner press roller 33 is preset to a value sufficient to cause printing ink to be formed on the inner press roller 33, and a gap between the second doctor roller 37 and the inner press roller 33 is reduced to some extent sufficient to avoid printing ink from being leaked. That is, when the inner press roller 33 rotates, printing ink with a given thickness is continuously adhered to an outer circumferential surface of the inner press roller 33 owing to the gap between the first doctor roller 36 and the press roller 33, allowing the inner press roller 33 to supply printing ink onto the screen 30.

In addition, a print sheet clamp segment 40 is located at a given position of an outer circumferential periphery of the press drum 27, thereby enabling to clamp an edge of the print sheet 41 which is used as a print medium.

The paper feed device 5 is constructed to have a paper feed tray 42 on which print sheets 41 each serving as a print medium are stacked, primary paper feed rollers 43*a*, 43*b* which are kept in press-contact with an uppermost print sheet 41 stacked on the paper feed tray 42, a pair of secondary paper feed rollers 44*a*, 44*b* which are located downstream the primary paper feed rollers 43*a*, 43*b* and a pair of transfer guide members 45*a*, 45*b* which form a transfer guide to guide the print sheet between the pair of secondary paper feed rollers 44*a*, 44*b* and the press drum 27.

The sheet discharge section 6 includes an upper limit guide segment 46, a sheet separator claw 47, which separates the print sheet 41 from the press drum 27 when the print sheet is not removed, a pair of sheet discharge rollers 48, 48 that transfer the print sheet 41, which is guided by the upper limit guide 46 and is separated with the sheet separator claw 47, and a paper receiving tray 49 which stacks the print sheets 41, which are discharged from the pair of sheet discharge rollers 48, 48, in a stacked state.

The stencil disposal sections 7 are located in the main body 8 in close proximity to the first and second printing drums 25 and 26, respectively. Each of the stencil disposal sections 7 includes a pair of stencil discharge rollers 50 and 51, which are located in the vicinity of each of the first and second printing drums 25 and 26 in a slightly spaced relationship relative to the outer peripheries thereof, a stencil guide belt 52 which guides a leading edge of the stencil sheet 11 released from the stencil clamp segment 29, a stencil discharge roller 53 which transfers the stencil sheet 11, guided with the stencil guide belt 52, while separating it from each of the first printing drum 25 and the second printing drum 26 in conjunction with the stencil discharge roller 51, a stencil disposal box 54 for receiving the stencil sheets 11 transferred from the stencil discharge rollers 51 and 53, and a stencil compressing plate 55 for compressing the stencil sheets 11 toward rearmost end of the stencil disposal box 54.

Figure 2:
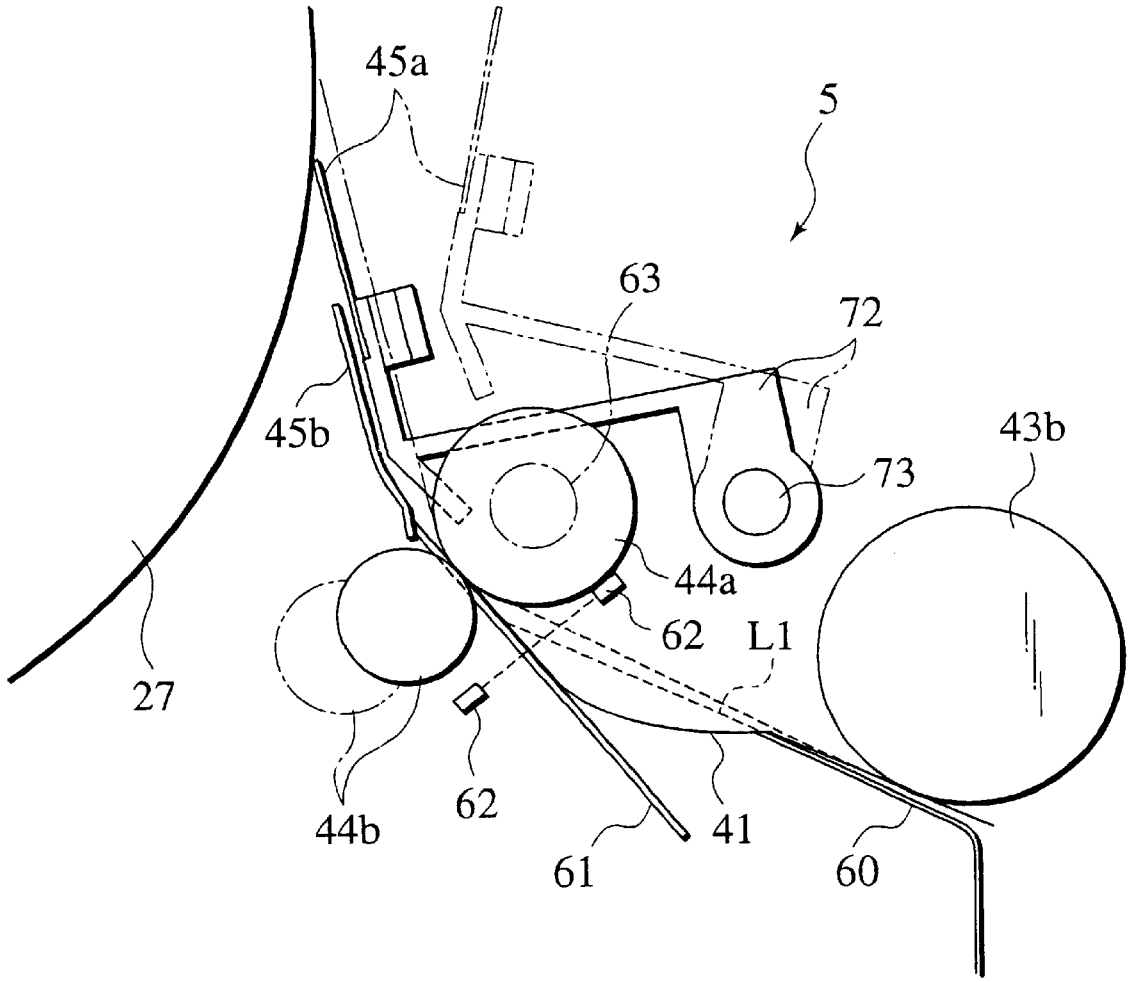
FIG. 2 is a schematic enlarged view of the print medium feed device of the stencil printing machine according to the embodiment.

Now, the structure of the paper feed device 5 is described below in detail. As seen in FIGS. 1 and 2, one primary paper feed roller 43*a* is held in press-contact with the uppermost print sheet 41, and the other primary paper feed roller 43*b* is held in pressured contact with an upper surface of a stripper plate 60 such that, when plural print sheets are concurrently transferred from the paper feed tray 42 at once with rotation of the primary paper feed roller 43*a*, a lower print sheet 41 is subjected to a traveling resistance exerted by the stripper plate 60 to allow only the uppermost print sheet 41 to be stripped with the primary paper feed roller 43*b* for thereby ensuring a stable transfer of a single print sheet 41 in a direction X1 close to the horizontal direction in FIG. 1.

Figure 7A:
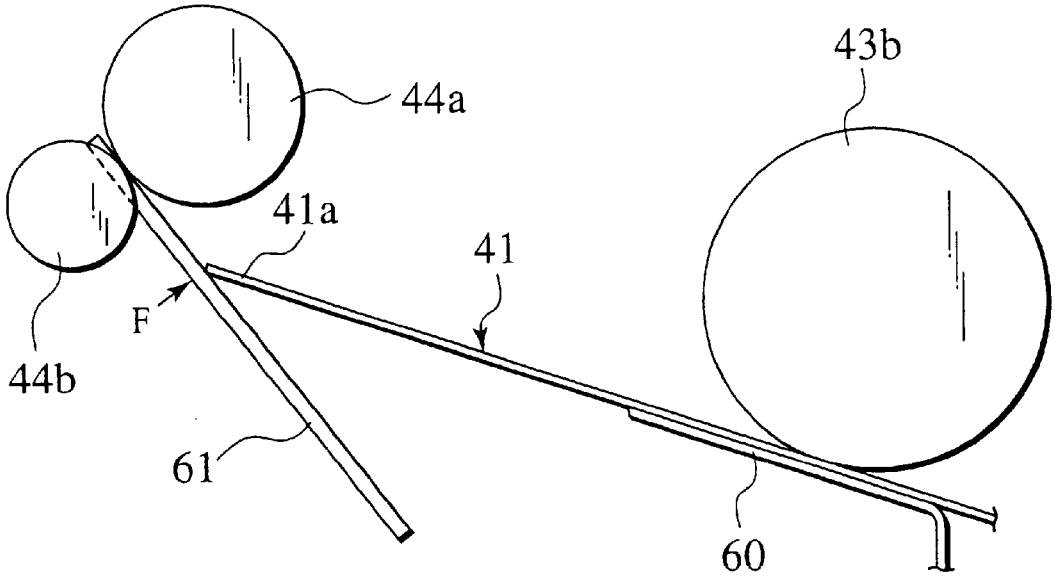
FIG. 7A is a schematic view illustrating an operating state wherein a print sheet is brought into abutting contact with a transfer guide plate during the primary paper feed step according to the embodiment.
Figure 7B:
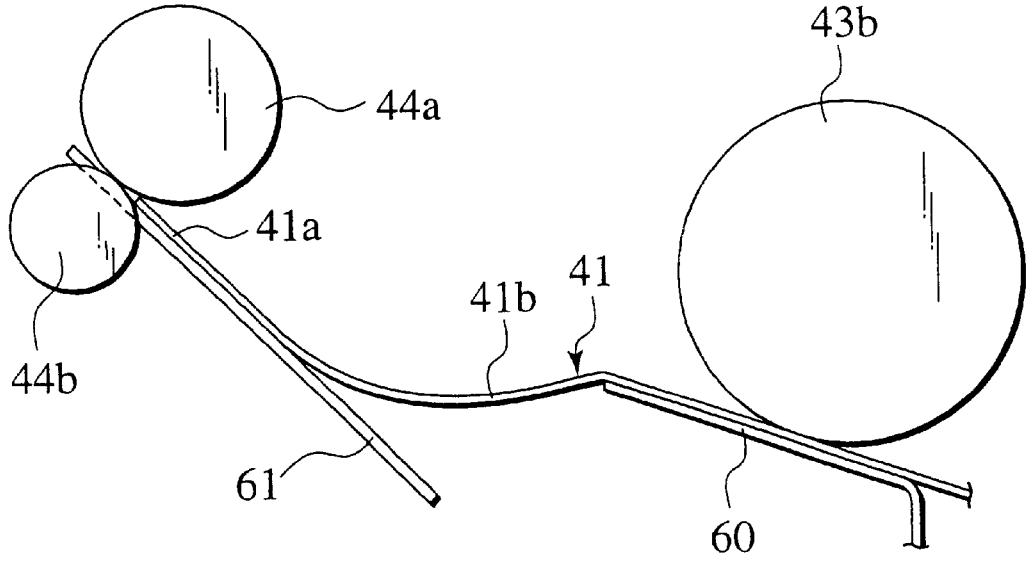
FIG. 7B is a schematic view illustrating another operating state wherein the print sheet completes its primary paper feed step according to the embodiment.
Figure 8:
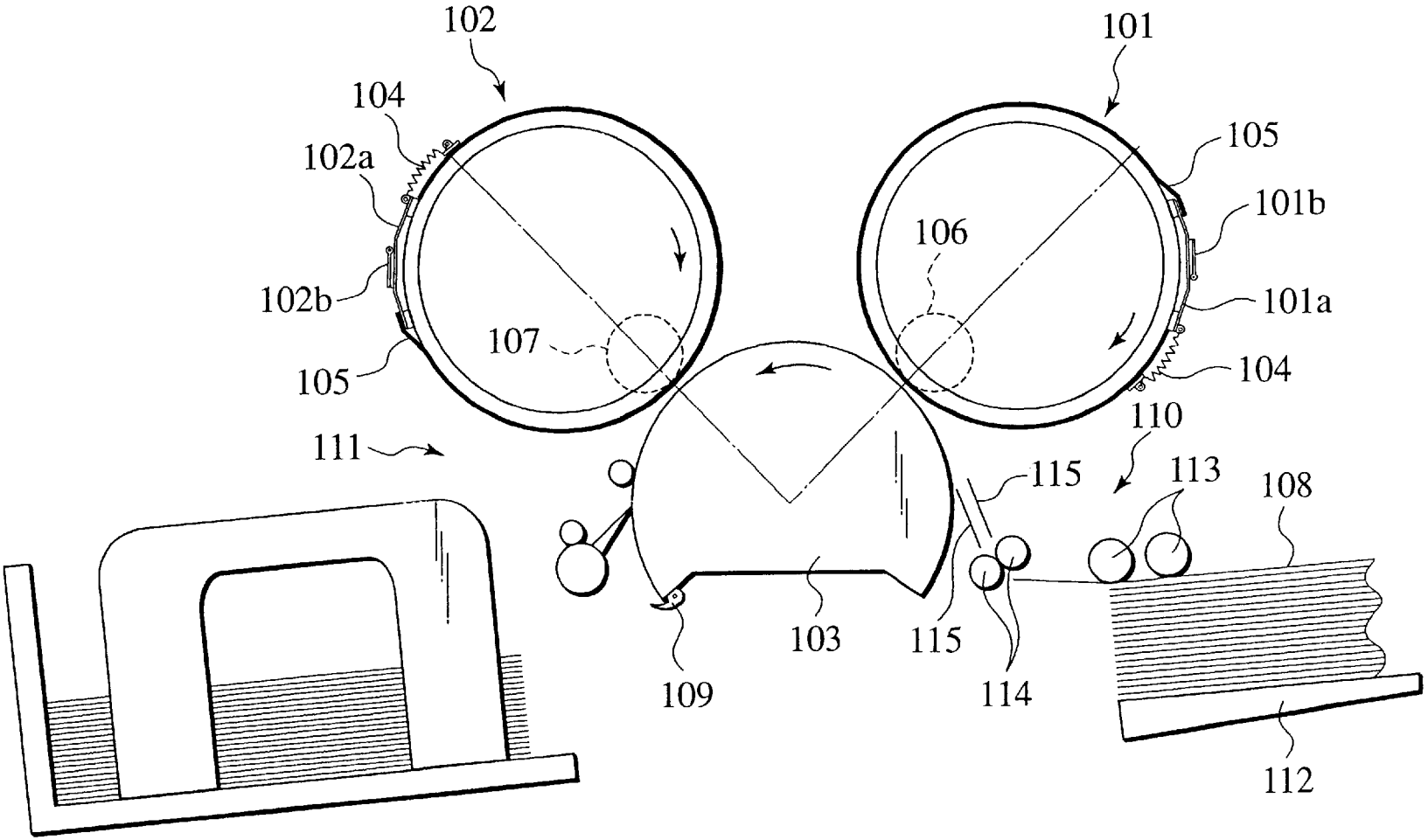
FIG.8 PRIOR ART
FIG. 8 is a schematic view for illustrating essential parts of a prior art stencil printing machine.

A guide plate 61 is located between the pair of primary feed rollers 43*a*, 43*b* and the pair of secondary feed rollers 44*a*, 44*b*, allowing a leading edge 41*a* of the print sheet 41 to be introduced between the pair of secondary paper feed rollers 44*a*, 44*b*. As viewed in FIG. 2, the stripper plate 60 is designed such that an extended line L1 extending from the upper surface of the stripper plate intersects the guide plate 61. With such an arrangement, as shown in FIG. 7A, the leading edge 41*a* of the print sheet 41, which has been transferred from the pair of primary paper feed rollers 43*a*, 43*b*, is caused to be brought into abutting contact with the guide plate 61, and, as shown in FIG. 7B, a leading side of the print sheet 41 is guided and bent upward owing to the guide plate 61 which is inclined. That is, in such an arrangement, the print sheet 41 is bent upward in the same direction as the pair of guide members 45*a*, 45*b* which guide the print sheet 41 from the pair of primary paper feed rollers 44*a*, 44*b* toward the press drum 27 in a direction X2 close to the vertical direction in FIG. 1. Turning back to FIG. 2, a slackness sensor 62 is located to detect the print sheet passing through a detection area defined between the pair of primary paper feed rollers 43*a*, 43*b* and the pair of secondary paper feed rollers 44*a*, 44*b*, allowing the slackness sensor 62 to detect the leading edge 41*a* of the print sheet 41 for determining the time instant at which a paper feed cycle of the print sheet 41 is determined.

Figure 5:
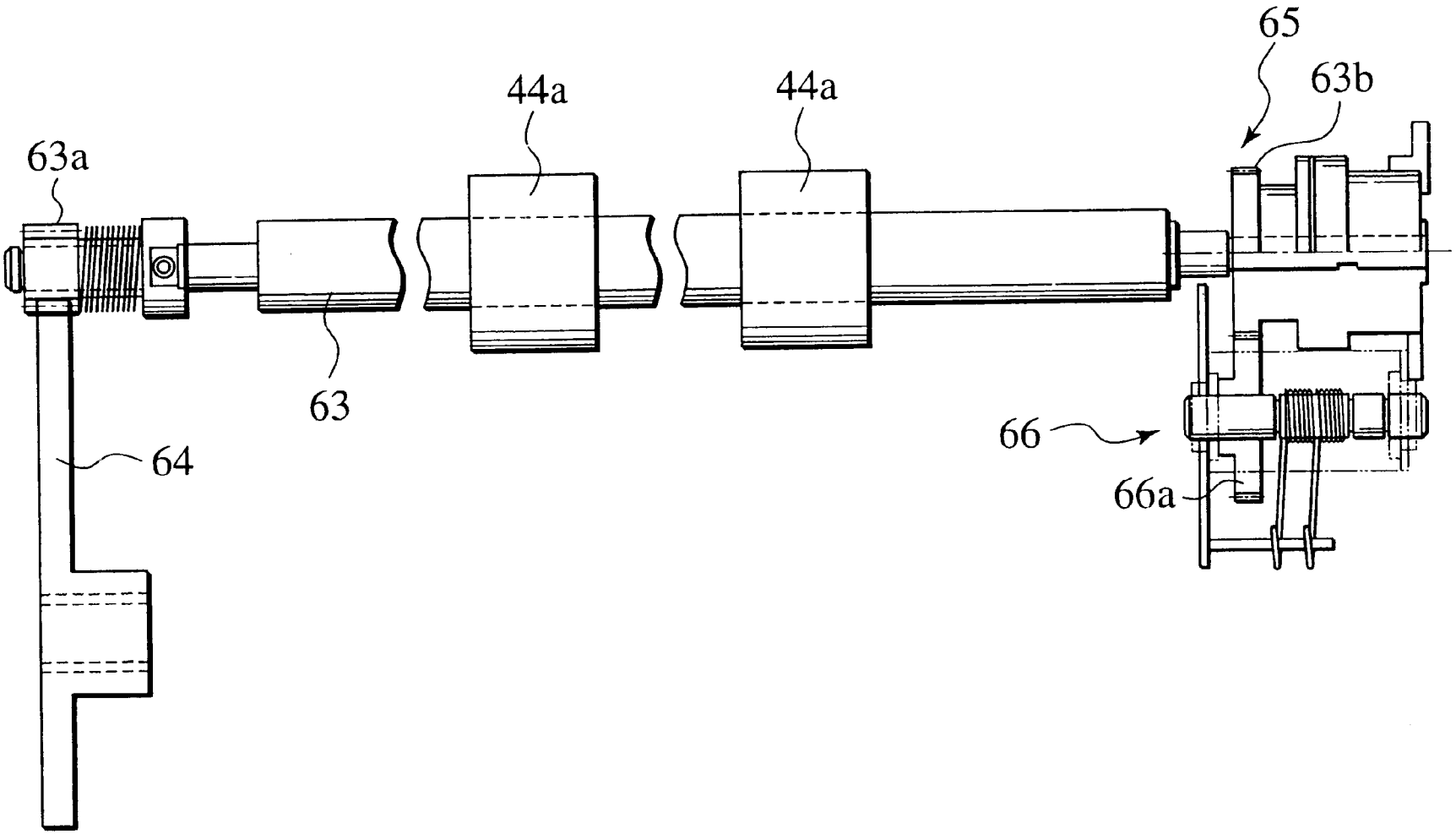
FIG. 5 is a front view of one of the secondary paper feed rollers forming a part of the print medium feed device according to the embodiment.

An upper secondary paper feed roller 44*a* is made of rubber material and a lower secondary paper feed roller 44*b* is made of plastic material. As seen in FIG. 5, one distal end of a rotatable shaft 63 of the upper secondary paper feed roller 44*a* has a gear 63*a* which meshes with a sector gear 64 that is driven with a main motor (not shown) to intermittently provide drive power to the rotatable shaft 63 such that the upper secondary paper feed roller 44*a* is intermittently rotated at given timings. The other distal end of the shaft 63 of the upper secondary paper feed roller 44*a* carries a gear 63*b* of a clutch section 65 that serves as a braking effect releasing unit which periodically release the rotational braking effect, wile the gear 63*b* being able to mesh with a gear 66*a* of a torque limiter 66 that serves as a rotation braking unit. When the clutch 65 is turned on, the torque limiter 66 functions to exert a rotational braking effect to the rotatable shaft 63. When the clutch section 65 is turned off, operation of the torque limiter 66 is interrupted, preventing the shaft 63 from being applied with rotational braking effect. The clutch section 65 is periodically turned on or turned off at prescribed timings in connection with a paper feed operation that will be described later in detail.

Figure 3:
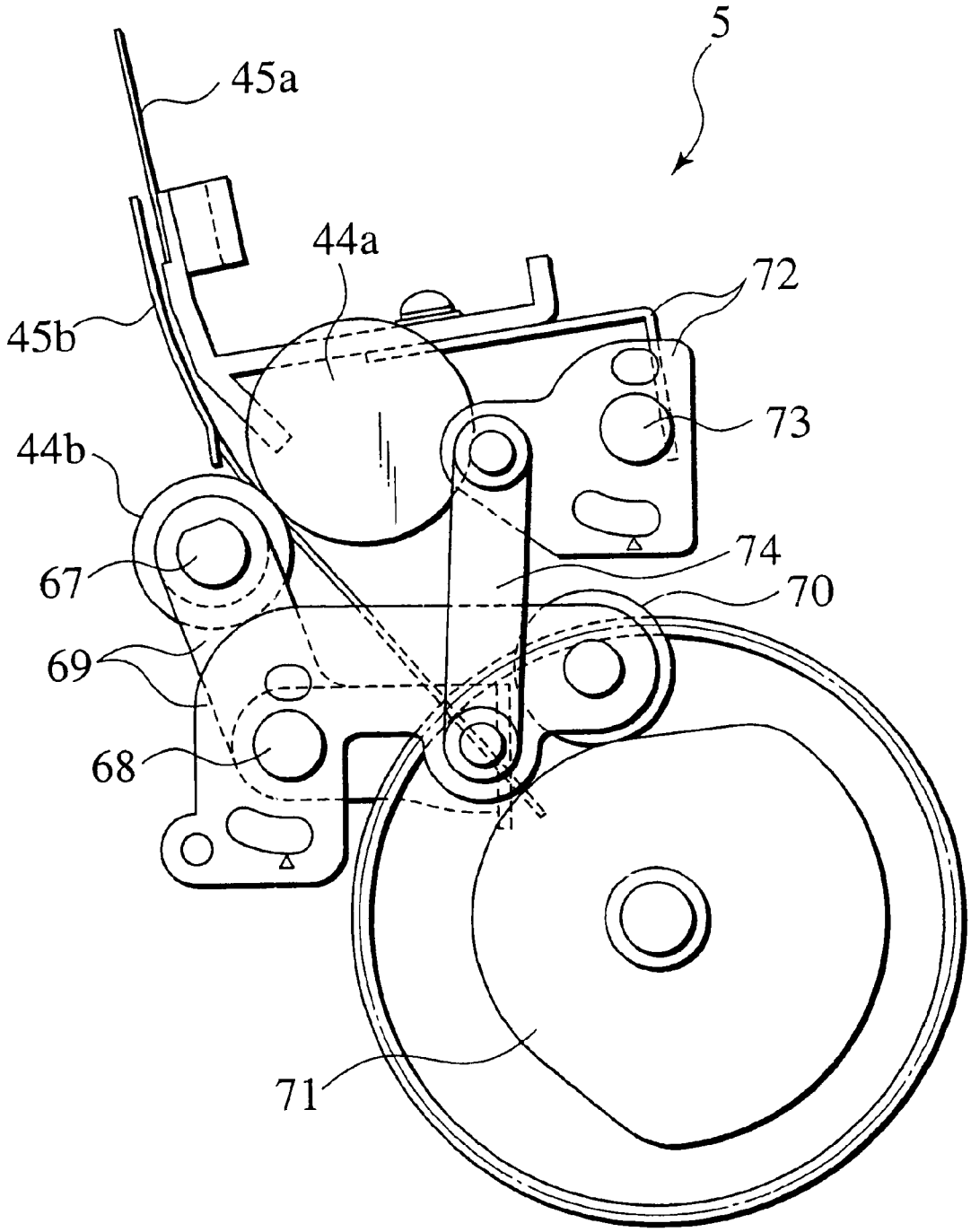
FIG. 3 is a view for illustrating an operating state of the print medium feed device according to the embodiment, wherein a pair of secondary paper feed rollers remain in a press-contact position and a pair of transfer guide members remain in a guide position.
Figure 4:
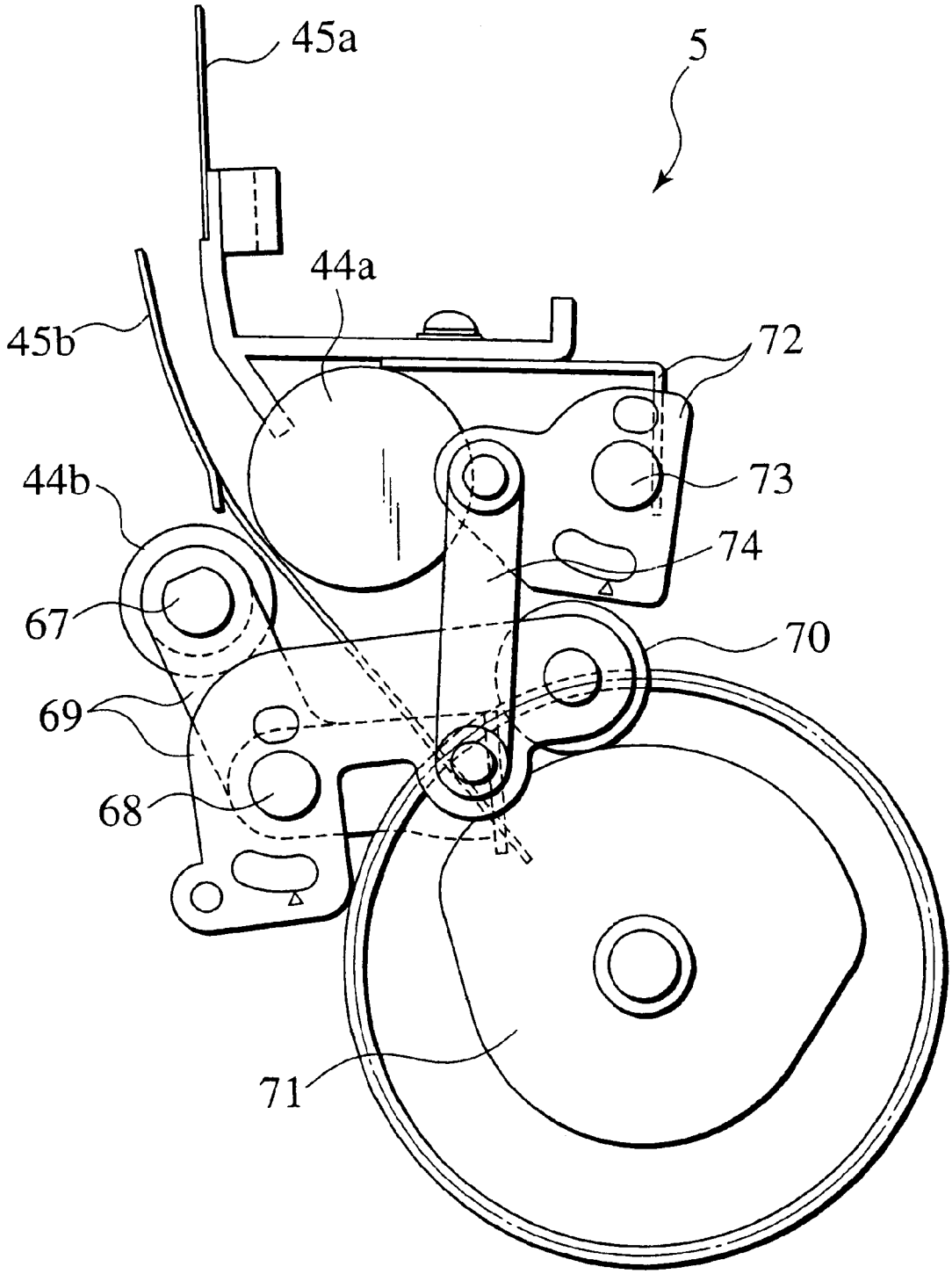
FIG. 4 is a view for illustrating another operating state of the print medium feed device according to the embodiment, wherein both the secondary paper feed rollers and the transfer guide members remain in inoperative or separate positions.

As shown in FIGS. 3 and 4, the lower secondary paper feed roller 44*b* has a shaft 67 which is rotatably supported by an actuating unit including an arm member 69 that is pivotally movable around the center of a pivot 68, with the arm member 69 carrying a cam roller 70. The cam roller 70 is held in contact with an outer circumferential periphery of a rotatable cam member 71 which forms a part of the actuating unit and which is rotated with the main motor that is not shown. That is, the lower secondary paper feed roller 44*b* is periodically moveable between a press-contact position (i.e., a position shown in FIG. 3) wherein the lower secondary paper feed roller 44*b* is held in pressured contact with the upper secondary paper feed roller 44*a* and an inoperative separate position (i.e., a position shown in FIG. 4) wherein the lower secondary paper feed roller 44*b* is remotely separate from the upper secondary paper feed roller 44*a*.

Among the transfer guide members 45*a,* 45*b,* an upper transfer guide member 45*a,* with which a trailing edge of the print sheet 41 is brought into contact, is fixedly mounted on a guide support member 72 which forms a part of the actuating unit and which is pivotally supported on a pivot shaft 73. The guide support member 72 and the arm member 69 are interconnected to one another with a linkage member 74 such that the upper guide transfer member 45*a* is periodically moveable in a link motion with the lower secondary paper feed roller 44*b*. That is, when the lower secondary paper feed roller 45*b* remains in the press-contact position, the upper secondary paper feed roller 45*a* is located in the guide position (i.e., the position shown in FIG. 3 and the position as indicated by a solid line in FIG. 2). When the lower secondary paper feed roller 44*b* remains in the separate position, the upper transfer guide member 45*a* is located in the separate position (i.e., the position shown in FIG. 4 and the position as indicated by a phantom line in FIG. 2). The upper transfer guide member 45*a* is periodically moved at given timings inn connection with the paper feed operation which will be described in detail later.

Two-color printing operation of the stencil printing machine 1 will be described below. In the original reader section 2, the original for printing is read out and respective image data are produced for the first printing color available for the first printing drum and the second printing color available for the second printing drum.

In the stencil making section 3, the elongated stencil sheet 11 is transferred with rotations of the platen roller 19 and the stencil sheet feed roller 20 to the thermal printing head 18 at which first and second stencil sheets 11 are thermally perforated, thereby producing the first and second stencil sheets 11 having first and second perforated image areas, which are formed on the basis of the image data read out by the original reader section 2. Trailing edges of the stencil sheets 11, which have the respective perforated image areas, are cut with the stencil sheet cutter 22 for thereby forming the first and second stencil sheets 11 in a given length for printing ink with the first color specified for the first printing drum 25 and for printing ink with the second color specified for the second printing drum 26. In addition, the stencil making unit 9 is moved to the first stencil sheet supply position such that the first stencil sheet 11 formed for printing ink with the first color is supplied onto the first printing drum 25, and the stencil making unit 9 is then moved to a second stencil sheet supply position such that the second stencil sheet 11 formed for printing ink with the second color is supplied onto the second printing drum 26.

In the printing section 4, the leading edge of the first stencil sheet 11 made by the stencil making section 3 is clamped with the stencil sheet clamp segment 29 of the first printing drum 25, with the first printing drum 25 being rotated while clamping the stencil sheet such that the stencil sheet 11 is wrapped around the outer periphery of the screen 30 of the first printing drum 25. Further, the leading edge of the second stencil sheet 11, made by the stencil making section 3, is clamped with the stencil sheet clamping segment 29 of the second printing drum 26, with the second printing drum 26 being rotated while clamping the second stencil sheet such that the second stencil sheet 11 is wrapped around the outer periphery of the screen 30 of the second printing drum 26.

In the paper feed device 5, the print sheet 41 is transferred in synchronism with rotations of the first printing drum 25, the second printing drum 26 and the press drum 27, which are described below, with the leading edge of the print sheet 41 being clamped by the print sheet clamp segment 40 of the press drum 27 to allow, during rotation thereof, the print sheet 11 to be transferred between the first printing drum 25 and the press drum 27.

In the printing section 4, on the other hand, each of the inner press rollers 33 is held in the wait position, except in printing operation, wherein each inner press roller 33 is held out of press-contact with each screen 30. During printing operation, each inner press roller 33 is brought into the operative, press-contact position in each of first and second contact zones to cause each of the first and second printing drums 25 and 26 to rotate with the press drum 27. Then, each inner press roller 33 rotates on the inner periphery of each screen 30 while pressing the inner periphery of the screen 30 in the contact zone. Since, in this instance, printing ink 38 is continuously supplied onto the outer periphery of each inner press roller 33, rotation of the inner press roller 33 transfers printing ink 38 onto the screen 30. Further, when the inner press roller 33 is brought into press-contact with the screen 30, the screen 30 associated with the inner press roller 33 is expanded toward the outer periphery thereof and is brought into press contact with the press drum 27 in the contact zone. In addition, as previously noted above, the print sheet 41 is transferred between the first printing drum 25 and the press drum 27 from the paper feed section 5, and the transferred print sheet 41 is further continuously fed under pressure exerted by the screen 30 and the first stencil sheet 11.

Then, the print sheet 41 is transferred between the second printing drum 26 and the press drum 27, and the transferred print sheet 41 is further continuously transferred under pressure exerted by the screen 30 and the second stencil sheet 11. During consecutive transferring steps under pressed conditions, printing ink 38 with the first and second colors is consecutively transferred to the print sheet 41 via the perforated image areas of the first and second stencil sheets 11, thereby completing print in a desired image with two colors. When the leading edge of the print sheet 41 passes across a position near the inner press roller 33 associated with the second printing drum 26 and comes downstream of the above position, the print sheet clamp segment 40 is released.

In the sheet discharge section 6, the leading edge of the print sheet 41 is guided with the upper limit guide 46, and the leading edge of the print sheet 41 is separated from the press drum 27 with the sheet separator claw 47, with a subsequent transfer of the print sheet 41 to the paper receiving tray 49 via the sheet discharge roller pair 48.

In the stencil disposal section 7, further, when beginning to make new stencil sheets, the preceding stencil sheets 11, which have been wound around the outer peripheries of the respective screens 30 of the first and second printing drums 25 and 26, are released from the stencil sheet clamp segments 29 of the first and second printing drums 25 and 26, respectively, such that the released leading edges of the stencil sheets 11 are guided with the stencil guide belts 52 while rotating the first and second printing drums 25 and 26 and the stencil sheets 11 are transferred with the stencil separating roller pairs 51 and 53, respectively, allowing the stencil sheets 11 to be discharged into the stencil disposal boxes 54.

Figure 6:
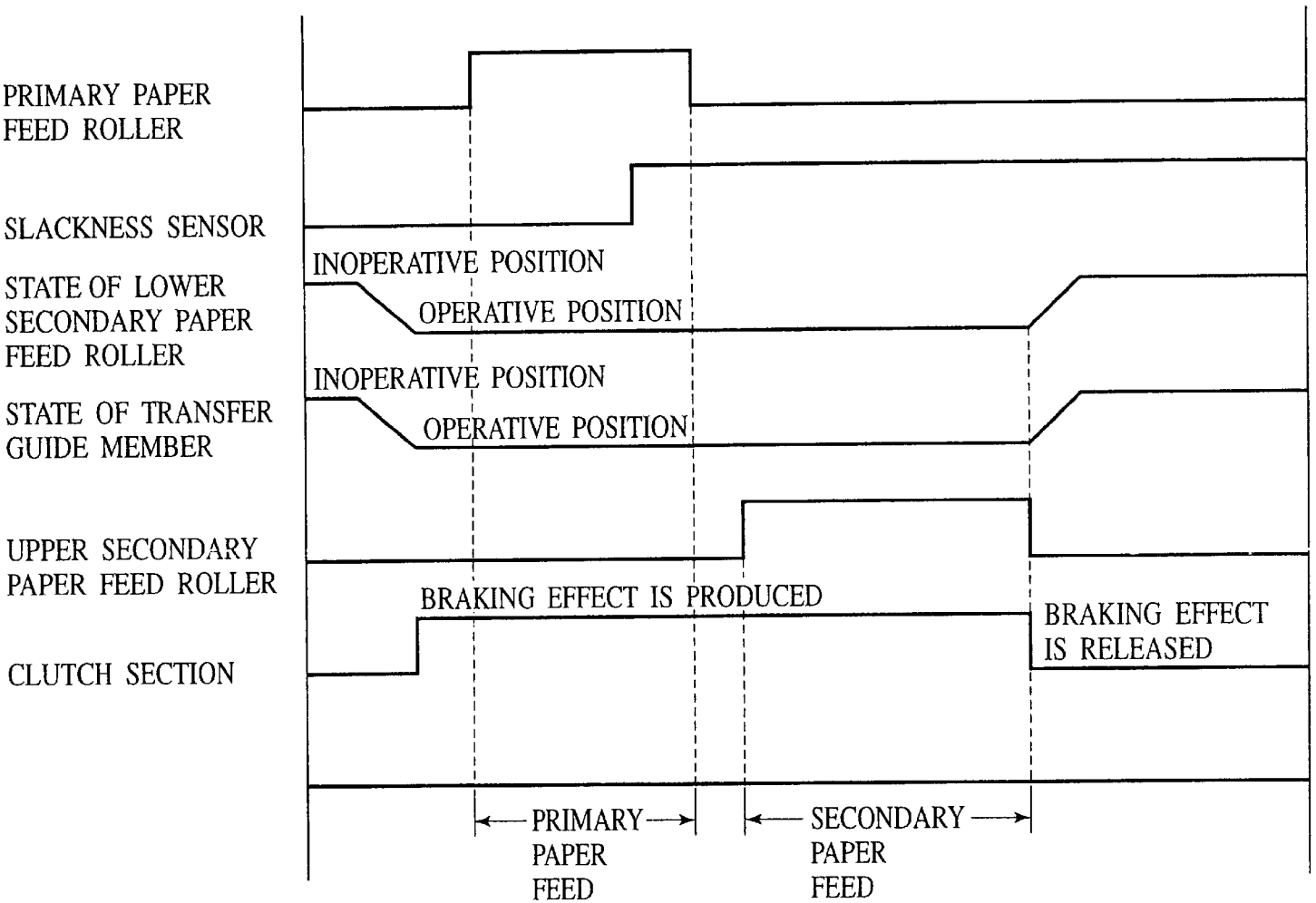
FIG. 6 is a view illustrating timing diagrams of a primary paper feed operation and a secondary paper feed operation according to the embodiment.

Now, the paper feed operation is described below with reference to timing diagrams shown in FIG. 6. When the main motor is started, the first and second printing drums 25 and 26 are rotated in synchronism with the press drum 27. In this event, rotation of the main motor is transferred at the given timings such that the lower secondary paper feed roller 44*b* is moved to the press-contact position from the separate position and the transfer guide member 45*a* is moved to the guide position (i.e., the position as shown by the solid line in FIG. 2 and the position shown in FIG. 3) from the separate position. When movements of the lower secondary paper feed roller 44*b* and the transfer guide member 45*a* are completed, the clutch section 65 is turned on such that the torque limiter 66 is brought into the operative position.

Subsequently, the pair of primary paper feed rollers 43*a*, 43*b* are rotated to implement a primary paper feed operation. The leading edge 41*a* of the print sheet 41 is guided with the guide plate 61 to enter between the pair of paper feed rollers 44*a*, 44*b*, and, when a given time interval has been elapsed after the leading edge 41*a* of the print sheet 41 has been detected by the slackness sensor 62, rotations of the pair of paper feed rollers 44*a*, 44*b* are terminated. During such a primary paper feed operation, the leading edge 41*a* of the print sheet 41 is brought into abutting contact with the guide plate 61 as viewed in FIG. 7A and is subjected to a reacting force as indicated by F in FIG. 7A, thereby causing the middle portion 41*b* of the print sheet 41 to be bent and deformed downward to form a circular-arc shaped downward projection in the same manner as that formed during a secondary paper feed operation which will be discussed later.

In a next step, the upper secondary paper feed roller 44*a* is rotated, thereby implementing a secondary paper feed operation. The print sheet 41 is guided and transferred through the pair of transfer guide members 45*a*, 45*b*, allowing the leading edge 41*a* of the print sheet 41 to be guided to the press drum 27 at a prescribed advancing or entering position and at a prescribed advancing or entering angle. The leading edge 41*a* of the print sheet 41 is then clamped with the print sheet clamp segment 40 of the press drum 27 and the print sheet 41 is successively transferred with the press drum 27. When the leading edge 41*a* of the print sheet 41 is clamped with the print sheet clamp segment 40, rotation of the upper secondary paper feed roller 44*a* is terminated. When rotation of the upper secondary paper feed roller 44*a* is terminated, the clutch section 65 is turned off and the torque limiter 66 is rendered inoperative wherein the torque limiter 66 becomes inoperative to produce the rotational braking effect. In this event, further, the lower secondary paper feed roller 44*b* is shifted from the press-contact position to the separate position and the transfer guide member 45*a* is shifted from the guide position to the separate position (see the position indicated by the phantom line in FIG. 2 and the position shown in FIG. 4).

The print sheet 41, which has ceased its secondary paper feed operation, is then transferred along the outer circumferential periphery of the press drum 27 during rotation thereof. During such a transfer of the print sheet, since the upper transfer guide member 45*a* has been shifted from the guide position to the separate position, the print sheet 41 is transferred without causing a trailing edge of the print sheet 41 to be brought into sliding contact with the transfer guide member 45*a* even when the trailing edge of the print sheet 41 is rendered to extend in a straight configuration due to resilient property of the print sheet 41. While, in this instance, the print sheet 41 is transferred with the trailing edge thereof remaining in contact with the upper secondary paper feed roller 44*a*, since the upper secondary paper feed roller 44*a* is not exerted with the rotational braking effect from the torque limiter 66, the print sheet 41 is transferred without resisting the rotational braking effect. It will thus be understood from the foregoing description that, during transfer of the print sheet 41 with rotation of the press drum 27, the print sheet 41 is not substantially exerted with a back tension.

That is, in such a printing machine discussed above, in which two printing drums 25, 26 are located relative to a single press drum 27 as in the stencil printing machine 1, since the first printing drum 25 is located at an obliquely upward region of the press drum 27 and the print sheet 41 is supplied to the press drum 27 at a point upstream of the first printing drum 25, the print sheet 41 is advanced toward the press drum 27 in a direction substantially perpendicular to the outer circumferential periphery thereof. On the contrary, the print sheet 41 is transferred from the paper feed tray 42 in a slanted direction angled at approximately 20 degrees relative to the horizontal line and, thus, the print sheet 41 is transferred in a paper feed path wherein an initial transfer angle of the print sheet 41 at the paper feed tray 42 and a subsequent advancing angle of the print sheet 41 relative to the press drum 27 are widely different from one another. In such a printing machine, the print sheet 41 is transferred with substantially no back tension during transfer of the print sheet 41 with the press drum 27.

In the preferred embodiment discussed above, although the stencil printing machine 1 employs an actuating unit to shift the transfer guide member 45*a* between the guide position and the non-guide position and a brake releasing unit to release the rotational braking effect of the secondary paper feed rollers 44*a*, 44*b*, for the transfer of the printing sheet 41 with the press drum 27, provision of either one of these units allows to minimize the back tension to be exerted to the print sheet 41 as low as possible during transfer of the print sheet 41 with the press drum 27.

In the preferred embodiment discussed above, further, since the transfer guide plate 45*a* is moved in a link motion with the movement of the secondary paper feed roller 44*b*, a shifting mechanism of the transfer guide member 45*a* may have a simplified structure.

In the preferred embodiment discussed above, furthermore, since the print sheet 41, which is transferred from the pair of primary paper feed rollers 43*a,* 43*b* to the pair of secondary paper feed rollers 44*a*, 44*b,* is guided through and is bent in the same direction as curved directions of the transfer guide members 45*a,* 45*b,* which function to guide the transfer of the print sheet 41 from the pair of secondary paper feed rollers 44*a,* 44*b* to the press drum 27, the print sheet 41 in the primary paper feed step is curved in the curved directions, allowing the print sheet 41 to be shifted from the primary paper feed mode to the secondary paper feed mode in a smooth fashion to ensure transfer of the print sheet 41 in a stable manner.

In the preferred embodiment discussed above, also, although the paper feed device 5 is applied to the stencil printing machine 1, the paper feed device 5 may be similarly applied to other type of a printing machine except for the stencil type provided that the print sheet is transferred in the paper transfer path wherein the initial paper transfer angle relative to the paper feed tray and the subsequent paper advancing angle relative to the printing section is widely different from one another due to some reasons. Further, although there has been described that the paper feed device 5 is applied to the stencil printing machine 11 which includes two printing drums 25, 26 located relative to the single press drum 27, the paper feed device 5 may also be applied to a printing machine which includes more than three printing drums relative to the single press drum 27, and a printing machine which includes a single press drum and which has a paper feed transfer path wherein the initial paper transfer angle relative to the paper feed tray 42 and the subsequent paper advancing angle relative to the press drum 27 is widely different from one another due to some reasons.

Incidentally in the preferred embodiment discussed above, although the print sheet 41 made of a paper is typically used as a print medium, another print medium can be preferably used if appropriate.

Summarizing the above, in the present invention, the print medium feed device and the stencil printing machine employing the same provide numerous advantages as below.

When the print medium is guided through the pair of transfer guide members and is introduced to the press drum which successively transfers the print medium, one of the transfer guide members is shifted from the guide position to the non-guide position to allow the trailing edge of the print medium to move without sliding contact with the one of the transfer guide members, thereby minimizing a back tension to be exerted onto the print medium as low as possible during transfer of the print medium.

Since the one of the transfer guide members is shifted in link motion with the one of the secondary paper feed rollers, an actuating unit for one of the transfer guide members can be formed in a compact and simplified structure.

In the event the print medium is guided through the pair of transfer guide members and is transferred to the press drum with rotations of the secondary paper feed rollers such that the print medium is transferred with rotation of the press drum, when the rotational braking effect of the rotational braking unit is released, the print medium is transferred with its trailing edge remaining in contact with one of the secondary paper feed rollers onto which the rotational braking effect is not exerted, thereby minimizing the back tension to be exerted to the print medium as low as possible during transfer of the print medium with the press drum.

In the event the print medium is guided through the pair of transfer guide members and is transferred to the press drum with rotation of the pair of secondary paper feed rollers such that the print medium is transferred with rotation of the press drum, when the one of the transfer guide members is moved from the guide position to the non-guide position and the rotational braking effect of the rotational braking unit is released, the print medium is transferred with its trailing edge remaining in contact with one of the secondary paper feed rollers onto which the rotational braking effect is not exerted, thereby maintaining the print medium from being exerted with substantially no back tension during transfer of the print medium with the press drum.

When the print medium is transferred in the primary paper feed step, the print medium is curved in a curved direction of a secondary paper feed step, thereby smoothly shifting the print medium from a primary paper feed mode to the secondary paper feed mode with a resultant stabilized transfer of the print medium.

In the stencil printing machine of the present invention, a plurality of printing drums are located in close proximity to the single press drum while perforated stencil sheets are mounted onto the respective printing drums wherein the print medium is transferred with the press drum to the stencil sheets of the respective printing drums with the synchronous rotations of the respective printing drums and the press drum while placing the print medium in press-contact with the respective stencil sheets to cause the printing ink with respective printing colors to be transferred through the perforated areas of the respective stencil sheets to be transferred to the print medium. Accordingly, the print medium is smoothly transferred in a stable fashion in the print medium transfer path wherein an initial print medium transfer angle relative to the paper feed tray and a subsequent print medium advancing angle relative to the press drum is widely different from one another.

The entire content of a Patent Application No. TOKUGAN 2000-164618 with a filing date of Jun. 1, 2000 in Japan is hereby incorporated by reference.

Although the invention has been described above by reference to a certain embodiment of the invention, the invention is not limited to the embodiment described above. Modifications and variations of the embodiment described above will occur to those skilled in the art, in light of the teachings. The scope of the invention is defined with reference to the following claims.

What is claimed is:

1. A stencil printing machine comprising:

a rotatable press drum;

a plurality of printing drums rotatably supported in close proximity to the press drum;

a stencil making section making stencil sheets to be mounted onto outer circumferential peripheries of the respective printing drums;

a feed tray stacking print media thereon;

a primary feed roller;

a pair of secondary feed rollers provided downstream to the primary feed roller in a transferring direction of the print medium, the print medium being fed to the pair of secondary feed rollers through the primary feed roller in a first transferring direction;

a pair of transfer guide members provided downstream to the pair of secondary feed rollers in the transferring direction of the print medium, the print medium being fed from the pair of secondary feed rollers to a predetermined member through the transfer guide members in a second transferring direction different from the first transferring direction; and an actuating mechanism shifting one of the pair of transfer guide members between a guide position in which the one of the pair of transfer guide members and the other of the pair of transfer guide members are close to each other to allow the print medium to be guided by the pair of transfer guide members and a non-guide position in which the one of the pair of transfer guide members is remotely separated from the other of the pair of transfer guide members, wherein a desired image pattern is formed on the print medium by supplying ink to the respective printing drums such that the ink is transferred to the print medium through the stencil sheets of the respective printing drums.

2. A stencil printing machine according to claim 1, wherein the actuating mechanism shifts one of the pair of secondary feed rollers between a press-contact position in which the one of the pair of secondary feed rollers and the other of the pair of secondary feed rollers are held in press-contact with each other and an inoperative separate position in which the one of the pair of secondary feed rollers is out of press-contact with the other of the pair of secondary feed rollers to prevent a transfer resistance from being imparted to the print medium.

3. A stencil printing machine according to claim 2, wherein the actuating mechanism actuates the one of the pair of secondary feed rollers and the one of the pair of transfer guide members in a link motion such that, when the one of the pair of secondary feed rollers remains in the press-contact position, the one of the pair of transfer guide members is located in the guide position and, when the one of the pair of secondary feed rollers remains in the inoperative separate position, the one of the pair of transfer guide members is located in the non-guide position.

4. A stencil printing machine according to claim 1, wherein a rotational braking mechanism coupled to the pair of secondary feed rollers and imparting a rotational braking effect thereto is provided.

5. A stencil printing machine according to claim 4, wherein a releasing mechanism releasing the rotational braking effect is provided.

6. A stencil printing machine according to claim 5, wherein the actuating mechanism shifts one of the pair of secondary feed rollers and the rotational braking effect is applied to the other of the pair of secondary feed rollers.

7. A stencil printing machine according to claim 1, wherein the primary paper feed roller and the pair of secondary paper feed rollers corporate with each other to allow the print medium to be curved in the same curve pattern as that applied by the pair of transfer guide members.

8. A stencil printing machine according to claim 1, wherein the print medium is a print sheet.

9. A stencil printing machine according to claim 1, wherein multicolored print is performed.

10. A print medium feed device comprising:

a feed tray stacking print media thereon;

a primary feed roller;

a pair of secondary feed rollers provided downstream to the primary feed roller in a transferring direction of the print medium, the print medium being fed to the pair of secondary feed rollers through the primary feed roller in a first transferring direction;

a pair of transfer guide members provided downstream to the pair of secondary feed rollers in the transferring direction of the print medium, the print medium being fed from the pair of secondary feed rollers to a predetermined member through the transfer guide members in a second transferring direction different from the first transferring direction; and an actuating mechanism shifting one of the pair of transfer guide members between a guide position in which the one of the pair of transfer guide members and the other of the pair of transfer guide members are close to each other to allow the print medium to be guided by the pair of transfer guide members and a non-guide position in which the one of the pair of transfer guide members is remotely separated from the other of the pair of transfer guide members.

11. A print medium feed device according to claim 10, wherein the actuating mechanism shifts one of the pair of secondary feed rollers between a press-contact position in which the one of the pair of secondary feed rollers and the other of the pair of secondary feed rollers are held in press-contact with each other and an inoperative separate position in which the one of the pair of secondary feed rollers is out of press-contact with the other of the pair of secondary feed rollers to prevent a transfer resistance from being imparted to the print medium.

12. A print medium feed device according to claim 11, wherein the actuating mechanism actuates the one of the pair of secondary feed rollers and the one of the pair of transfer guide members in a link motion such that, when the one of the pair of secondary feed rollers remains in the press-contact position, the one of the pair of transfer guide members is located in the guide position and, when the one of the pair of secondary feed rollers remains in the inoperative separate position, the one of the pair of transfer guide members is located in the non-guide position.

13. A print medium feed device according to claim 10, wherein a rotational braking mechanism coupled to the pair of secondary feed rollers and imparting a rotational braking effect thereto is provided.

14. A print medium feed device according to claim 13, wherein a releasing mechanism releasing the rotational braking effect is provided.

15. A print medium feed device according to claim 14, wherein the actuating mechanism shifts one of the pair of secondary feed rollers and the rotational braking effect is applied to the other of the pair of secondary feed rollers.

16. A print medium feed device according to claim 1, wherein the primary paper feed roller and the pair of secondary paper feed rollers corporate with each other to allow the print medium to be curved in the same curve pattern as that applied by the pair of transfer guide members.

17. A print medium feed device according to claim 1, wherein the print medium is a print sheet.

18. A print medium feed device comprising:

a feed tray stacking print media thereon;

a primary feed roller;

a pair of secondary feed rollers provided downstream to the primary feed roller in a transferring direction of the print medium, the print medium being fed to the pair of secondary feed rollers through the primary feed roller in a first transferring direction;

a pair of transfer guide members provided downstream to the pair of secondary feed rollers in the transferring direction of the print medium, the print medium being fed from the pair of secondary feed rollers to a predetermined member through the transfer guide members in a second transferring direction different from the first transferring direction;

a rotational braking mechanism coupled to the pair of secondary feed rollers and imparting a rotational braking effect thereto; and a releasing mechanism releasing the rotational braking effect.

* * * * *

UNITED STATES PATENT AND TRADEMARK OFFICE

CERTIFICATE OF CORRECTION

PATENT NO. : 6,581,514 B2
DATED : June 24, 2003
INVENTOR(S) : Kakurai

It is certified that error appears in the above-identified patent and that said Letters Patent is hereby corrected as shown below:

Column 16,
Lines 39 and 44, change "1" to -- 10 --.

Signed and Sealed this

Seventh Day of October, 2003

JAMES E. ROGAN
*Director of the United States Patent and Trademark Office*